US005932127A

United States Patent [19]

Maddox

[11] Patent Number: 5,932,127

[45] Date of Patent: Aug. 3, 1999

[54] HEATER CONTROL FOR SPA

[76] Inventor: Harold D. Maddox, 633 S. College Dr., Santa Maria, Calif. 93454

[21] Appl. No.: 09/007,734

[22] Filed: Jan. 15, 1998

[51] Int. Cl.[6] ..... H05B 1/02; A47K 3/00

[52] U.S. Cl. ..... 219/492; 4/541.2; 4/493; 236/46 R

[58] Field of Search ..... 4/541.2, 493; 219/492; 236/46 R

[56] References Cited

U.S. PATENT DOCUMENTS 4,233,694 11/1980 Janosko et al. ..... 4/542
4,780,197 10/1988 Schuman ..... 210/136
5,585,025 12/1996 Idland ..... 219/497
5,809,796 9/1998 Zakryk ..... 4/493 X

*Primary Examiner*—William Wayner
*Attorney, Agent, or Firm*—Daniel C. McKown

[57] ABSTRACT

A spa is maintained at a ready-to-use temperature by a daily heating cycle that is initiated by a filter cycle clock, which traditionally has been used only for programming the circulation of the spa water through a filter. Once a daily heating cycle has been initiated, it normally concludes only when the temperature of the spa water reaches a desired temperature that the user has preset into a thermostat. However, for safety the heating cycle is terminated immediately in the event the heater temperature becomes excessive, since this event could result from lack of water or inadequate circulation.

1 Claim, 2 Drawing Sheets

HEATER CONTROL FOR SPA

BACKGROUND OF THE INVENTION

1. Field of the Invention

The present invention is in the field of spas and more particularly relates to a method for controlling the heating cycle of a spa that keeps the spa at a ready-to-use temperature with a minimum of human intervention.

2. The Prior Art

The type of spa with which the system of the present invention is intended to be used is typically several times larger than a bathtub. Frequently, the spa is located outdoors and is provided with its own heater and pumps for heating and circulating hot water. To maintain the cleanliness of the water, the spa is equipped with a filter and filter pump that draws water from the spa, passes it through a filter, and returns it to the spa.

Spas vary widely in the manner in which the various functions are coordinated. In some spas, the operator must initiate each function, while other spas are programmed to provide various water temperatures at specified times.

In U.S. Pat. No. 4,780,197 issued Oct. 25, 1988, Schuman describes a filtration system in which the pump normally operates on a daily ON-OFF cycle determined by an adjustable timer.

In U.S. Pat. No. 4,233,694 issued Nov. 18, 1980 to Janosko et al., there is described a control system for a spa that protects the heater against overheating when the water level has fallen and in which operation of both the filter pump and the heater are initiated by the user. In U.S. Pat. No. 5,585,025 issued Dec. 17, 1996, Idland describes a spa control circuit that includes protection against overheating. The control system includes a single thermometer that detects the temperature of the spa water. The temperature is supplied to a thermostat that uses an ON-OFF control mode to maintain water temperature between normal operating limits.

In U.S. Pat. No. 5,559,720 issued Sep. 24, 1976, Tompkins et al., describe a spa control system that uses a microprocessor and that begins to warm the water in advance of actual use.

In U.S. Pat. No. 5,079,784 issued Jan. 14, 1992, Rist et al., describe a control system that uses a proportional mode of control in which the current to the heater is reduced as the temperature approaches the temperature set on the thermostat. The system also includes a safety circuit that prevents operation of the heater unless the pump is circulating water.

Although some individual features of the present invention can be found in the prior art, the overall system of the present invention and its mode of operation appear to be unknown.

BRIEF SUMMARY OF THE INVENTION

The present invention maintains a spa at a near ready-to-use temperature by warming the water to a preset temperature each day. This is accomplished without intervention by the user, by using the filter cycle clock to initiate the daily heating cycle. In the known prior art, the filter cycle clock was used solely for the purpose of programming the circulation of water through a filter to clean the water. In accordance with the present invention a second task is assigned to the filter cycle clock, namely initiating a daily heating cycle to maintain the temperature of the spa. The user can, of course, initiate a heating cycle at any time, and can also alter the desired temperature set into the thermostat.

Once a heating cycle has been initiated, the heater continues to supply heat to the spa water until the temperature of the water has reached a desired temperature that has been preset on the thermostat, at which point the heater is switched off. The heater is also switched off, in the interest of safety, if the heater temperature becomes excessive, as might occur if the spa lacks water or if the pump that circulates the water has failed.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE INVENTION

Figure 1:
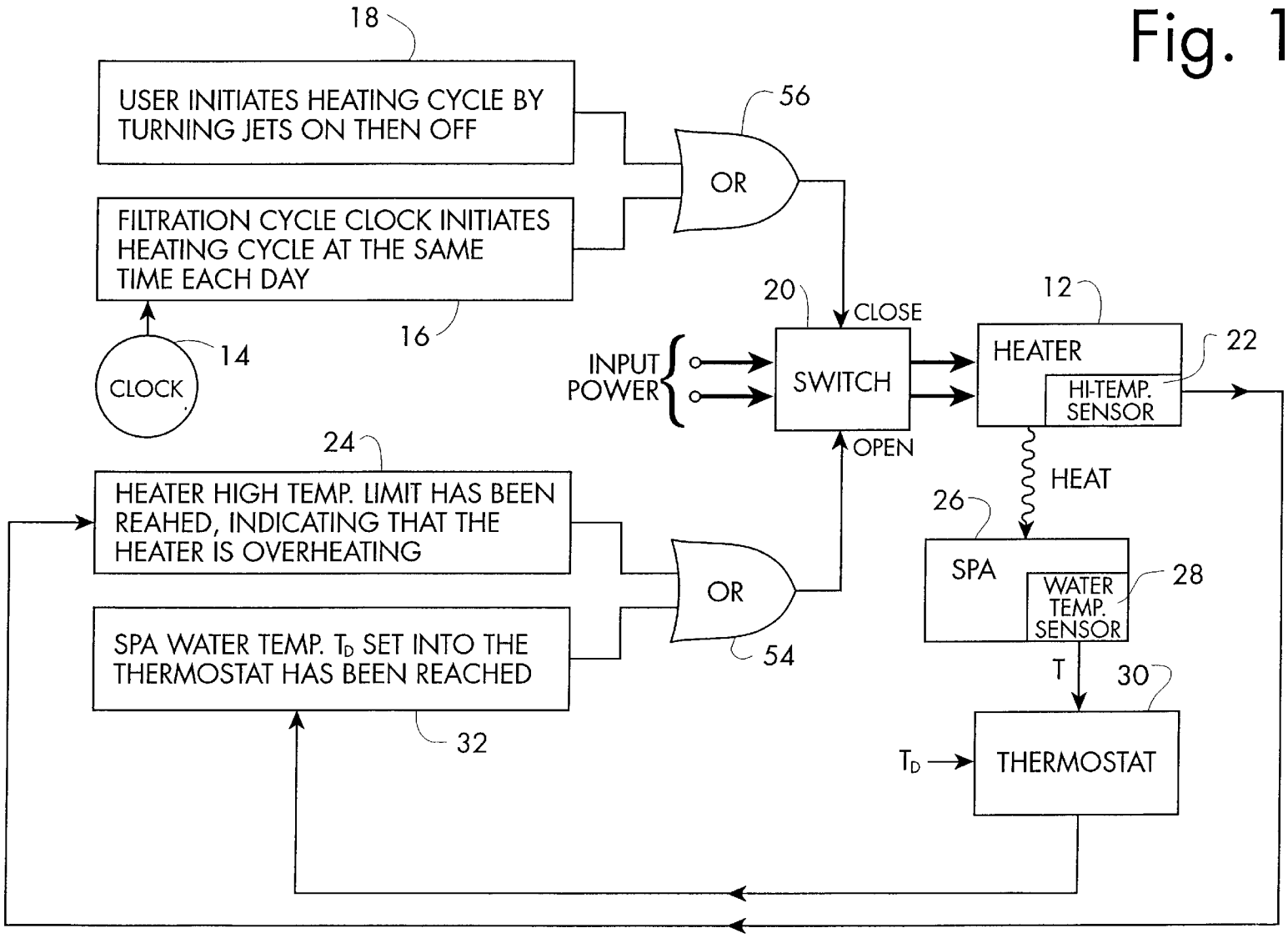
FIG. 1 is a diagram illustrating the method of the present invention.

The diagram of FIG. 1 expresses the method used in the present invention to determine when electrical power should be applied to the heater 12, and when the power should be turned off. The spa is equipped with a clock switch 14 that is used for initiating operation of a pump to circulate the spa water through a filter at a preset time each day for the purpose of maintaining the cleanliness of the spa water. As indicated by block 16 of FIG. 1, in accordance with the present invention a heating cycle is also initiated concurrently with the filtration cycle, so that the spa heat is maintained on a daily basis.

As indicated by the block 18 of FIG. 1, it is also possible for the user to initiate a heating cycle at any time by closing a particular switch. In the preferred implementation, this same switch turns the jets on, and once the jets have been turned on, ever so briefly, the heating cycle thus started will automatically proceed to completion.

Thus, in accordance with the present invention, a heating cycle can be initiated only in the two ways referred to in blocks 16 and 18 of FIG. 1. Either of the two conditions results in the switch 20 being closed, thereby applying electrical power to the heater 12.

The heater 12 includes a high-temperature sensor 22 that serves as a safety device. As indicated by the block 24 of FIG. 1, when the heater becomes excessively hot, the switch 20 is opened thereby disconnecting the heater 12 from the input power.

When heat is supplied by the heater 12 to the spa 26, the temperature T of the water rises, as sensed by the water temperature sensor 28. When the water temperature T equals or exceeds the temperature $T_D$ set into the thermostat 30, the switch 20 is opened, as indicated by the block 32. Thus, in accordance with the present invention there are only two ways in which a heating cycle, once begun, can be terminated. First, the heating cycle terminates when the desired water temperature has been reached, and second, the heating cycle is terminated anytime the heater 12 becomes abnormally hot.

Figure 2:
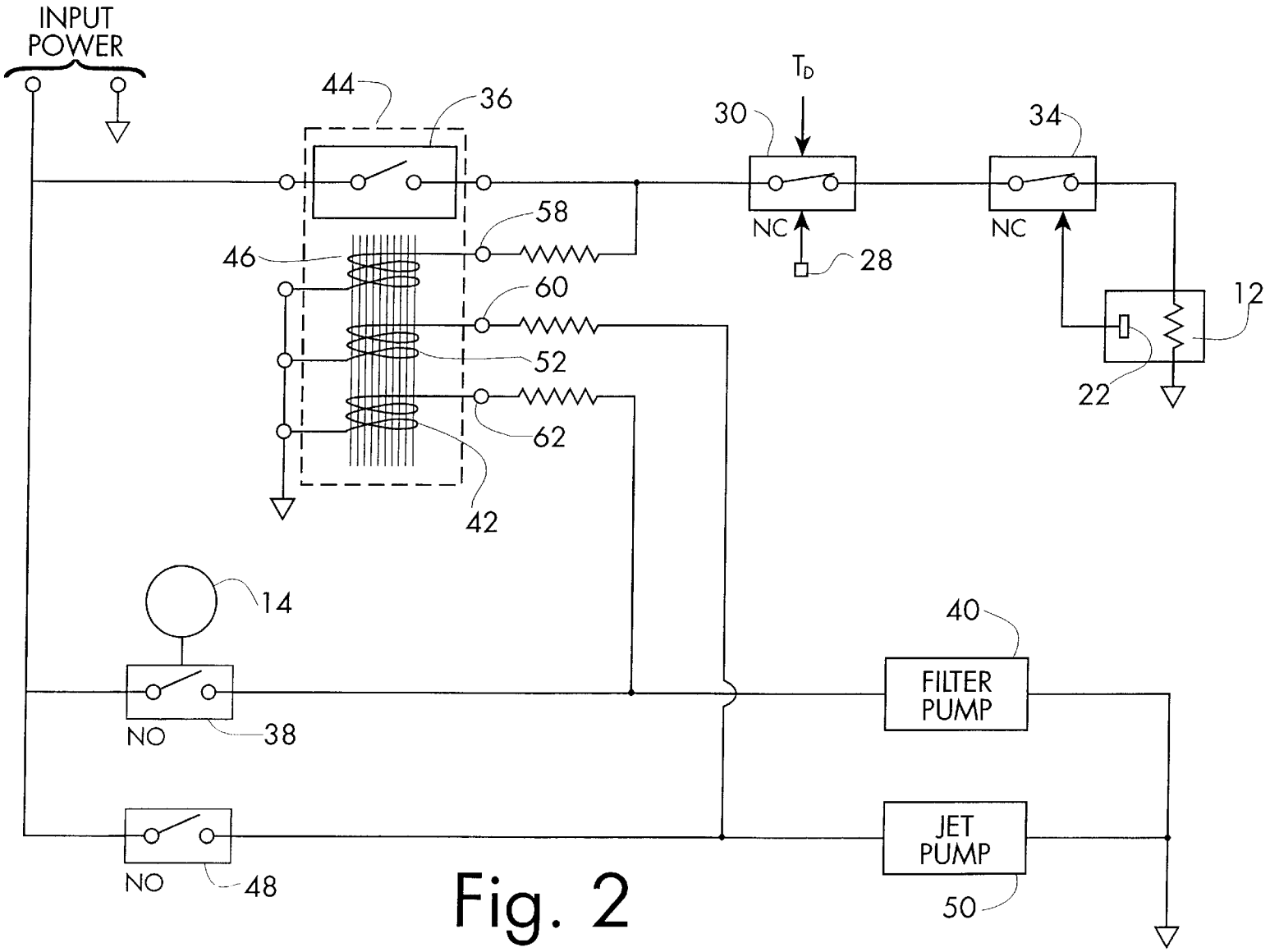
FIG. 2 is an electrical diagram showing the apparatus used to implement a preferred embodiment of the present invention.

The diagram of FIG. 1 is a heuristic explanation of the method of the present invention, and the electrical diagram of FIG. 2 discloses the apparatus used to implement the method in a preferred embodiment of the present invention.

The switch 20 of FIG. 1 is implemented by the thermostat switch 30, the high temperature dropout switch 34, and the relay switch 36 of FIG. 2.

In the course of the daily filtration cycle, the clock 14 closes the switch 38 for a preset interval at a preset time each day. Closing of the switch 38 turns on the filter pump 40, thereby circulating the spa water through a filter to clean it.

In accordance with the present invention, closure of the switch 38 also applies a small current to the coil 42 of the relay 44, thereby closing the relay switch 36, which makes power available to the heater 12 through the normally-closed switches 30 and 34. Closure of the switch 36 also applies a small current to the coil 46 of the relay 44, thereby holding the switch 36 closed until either the switch 30 or the switch 34 opens.

Likewise, the user may initiate a heating cycle by manually closing the switch 48 that turns on the jet pump 50. Closure of the switch 48 applies a small current to the coil 52 of the relay 44, thereby closing the switch 36 and initiating a heating cycle. Closure of the switch 36 results in a small current through the coil 46 thereby holding the switch 36 closed until either the switch 30 or the switch 34 opens.

Comparison of FIGS. 1 and 2 will show that the OR function 54 has been implemented by the series combination of the normally-closed switches 30 and 34. Also, the OR function 56 has been implemented through the use of the coils 42 and 52 of the relay 44.

In other embodiments, the relay 44 is replaced by a high current solid state switch triggered by voltages applied to the terminals 58, 60 and 62. In still other embodiments, the relay 44 is replaced by a gas power switch such as a thyratron that is triggered by voltages on the terminals 58, 60 and 62.

In the preferred embodiment of the present invention, once the heating cycle has begun, it continues until the spa water has reached the desired temperature, unless interrupted by overheating of the heater. That is, the heating cycle continues even if, at some point in the heating cycle, the filtration interval is completed or the jet pumps are turned off.

This mode of operation assures that the spa remains near a ready-to-use temperature, regardless of when actual use occurs. Also, the mode of operation does not interfere with the normal daily filtration cycle, and in fact takes advantage of that cycle to initiate a daily heat-maintaining cycle. Experience has shown that the mode of operation used in the present invention proves to be highly convenient and requires a minimum of anticipatory action on the part of the user.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A method of controlling the operation of a spa heater comprising the steps of:

turning the heater on at a preset time each day as determined by the filtration cycle clock, and turning the heater on anytime the user actuates a particular switch; and, turning the heater off when a preset water temperature has been reached as determined by a water temperature sensor, and turning the heater off when the temperature of the heater exceeds a preset temperature, as determined by a heater temperature sensor.

* * * * *